US005555866A

United States Patent [19]

Wilson

[11] Patent Number: 5,555,866

[45] Date of Patent: Sep. 17, 1996

[54] ROTARY ENGINE

[76] Inventor: Jack A. Wilson, 121 Palmwood Dr., Pass Christian, Miss. 39571

[21] Appl. No.: 467,300

[22] Filed: Jun. 6, 1995

[51] Int. Cl.[6] ..... F02B 53/00

[52] U.S. Cl. ..... 123/240; 123/203; 123/205

[58] Field of Search ..... 123/203, 205, 123/240; 60/624; 418/138, 241

[56] References Cited

U.S. PATENT DOCUMENTS

| | | | |
|---|---|---|---|
| 1,101,794 | 6/1914 | Friend | 123/203 |
| 1,529,352 | 3/1925 | Hagberg et al. | 60/624 |
| 3,165,093 | 1/1965 | Etxegoien | 123/240 |
| 3,181,510 | 5/1965 | Hovey . | |
| 3,194,220 | 7/1965 | Dowell et al. | 123/240 |
| 3,289,653 | 12/1966 | Kuttes | 123/240 |
| 3,572,985 | 3/1971 | Runge . | |
| 3,976,037 | 8/1976 | Hojnowski . | |
| 4,024,840 | 5/1977 | Christy | 418/241 |
| 4,077,366 | 3/1978 | Hideg et al. . | |
| 4,096,828 | 6/1978 | Satou et al. . | |
| 4,203,410 | 5/1980 | Ramer | 123/205 |
| 4,760,701 | 8/1988 | David . | |
| 4,848,296 | 7/1989 | Lopez . | |
| 4,926,816 | 5/1990 | Kita et al. . | |
| 5,251,596 | 10/1993 | Westland . | |
| 5,271,365 | 12/1993 | Oppenheim et al. . | |
| 5,310,325 | 5/1994 | Gulyash . | |

FOREIGN PATENT DOCUMENTS

| | | | |
|---|---|---|---|
| 1358623 | 3/1964 | France | 123/240 |
| 320708 | 4/1920 | Germany | 123/240 |
| 726063 | 10/1942 | Germany | 60/624 |
| 2354845 | 7/1974 | Germany | 123/203 |
| 2423949 | 12/1975 | Germany | 123/240 |
| 646857 | 9/1962 | Italy | 123/240 |

*Primary Examiner*—Michael Koczo
*Attorney, Agent, or Firm*—Nies, Kurz, Bergert & Tamburro

[57] ABSTRACT

A rotary internal combustion engine has a double pivot center and allows for efficient communication between a central cylindrical intake/compression chamber and a crescent-shaped expansion chamber. Power packs rotating about the upper pivot location receive compressed gases from the compression chamber located within a flywheel which is positioned to rotate about the lower pivot location. Intake gases are ultimately compressed within the power packs before being ignited and causing a delayed powering of the power packs through the expansion chamber. Intermeshing of the power packs with the flywheel allows for the conversion of the power of the expanding gases acting on the power pack into rotation of the flywheel to power a drive shaft intimately mounted to the flywheel. Further optional treatment of the combusted gases provides more power to the drive shaft and such treatment may include, for example, fuel injection, water injection, further sparking, clean air injection and high compression turbine operation. The engine provides for rotary motion of all moving parts and the engine power packs use every stroke of the four stroke internal combustion engine during each revolution of the flywheel.

28 Claims, 6 Drawing Sheets

ROTARY ENGINE

BACKGROUND AND SUMMARY OF THE INVENTION

This invention relates to engines, and more particularly to a Rotary internal combustion engine which allows for the complete treatment of the combusted gases, greater efficiency of the gas cycle and cleaner exhaust than present day engines.

Prior art rotary internal combustion engines are described, for example, in the following U.S. Pat. Nos.: 3,165,093 to Etxegoien; 3,181,510 to Hovey; 3,572,985 to Runge; 3,976,037 to Hojnowski; 4,077,366 to Hideg et al.; 4,096,828 to Satou et al.; 4,848,296 to Lopez; 4,926,816 to Kita et al.; 5,251,596 to Westland et al.; and 5,310,325 to Gulyash.

By the present invention, there is provided a rotary internal combustion engine having an engine block with a hollow interior in the shape of two overlapping cylinders. A flywheel occupies the lower cylindrical cavity of the engine block interior and has an internal bore which defines a cylindrical compression chamber. The flywheel is rotatable about the longitudinal axis of the lower cylindrical cavity. The outer surface of the flywheel and the interior surface of the upper cylindrical cavity define a crescent shaped expansion chamber.

Power packs rotate about a stationary power shaft extending through the flywheel along the longitudinal axis of the upper cylindrical cavity of the engine block interior. The power packs intermesh with the flywheel such that rotation of the power packs about the shaft results in rotation of the flywheel. As the power packs rotate past an intake opening, combustion materials are vacuumed into the cylindrical chamber to be compressed.

As the power packs rotate further about the power shaft, the combustion materials are ultimately compressed into a cross-fire combustion chamber within each power pack before being ignited by a spark plug positioned in an injection opening in the engine block. The resulting release of power into the expansion chamber from the explosion in the combustion chamber propels the power packs through the expansion chamber, thereby rotating the flywheel which then rotates a drive shaft held in communication with the flywheel. Further treatment of the combustion materials is optionally provided through additional injection openings in the engine block. Such treatment may include, for example, fuel injection, water injection, additional sparking, and clean air injection. The spent gases finally exit the expansion chamber and may then enter a turbine employed to extract further power from the highly exploded gases to rotate the drive shaft. The complete treatment of the combusted gases allows the engine to produce relatively pollutant-free exhaust.

DESCRIPTION OF THE PREFERRED EMBODIMENTS

Figures 1, 1A:
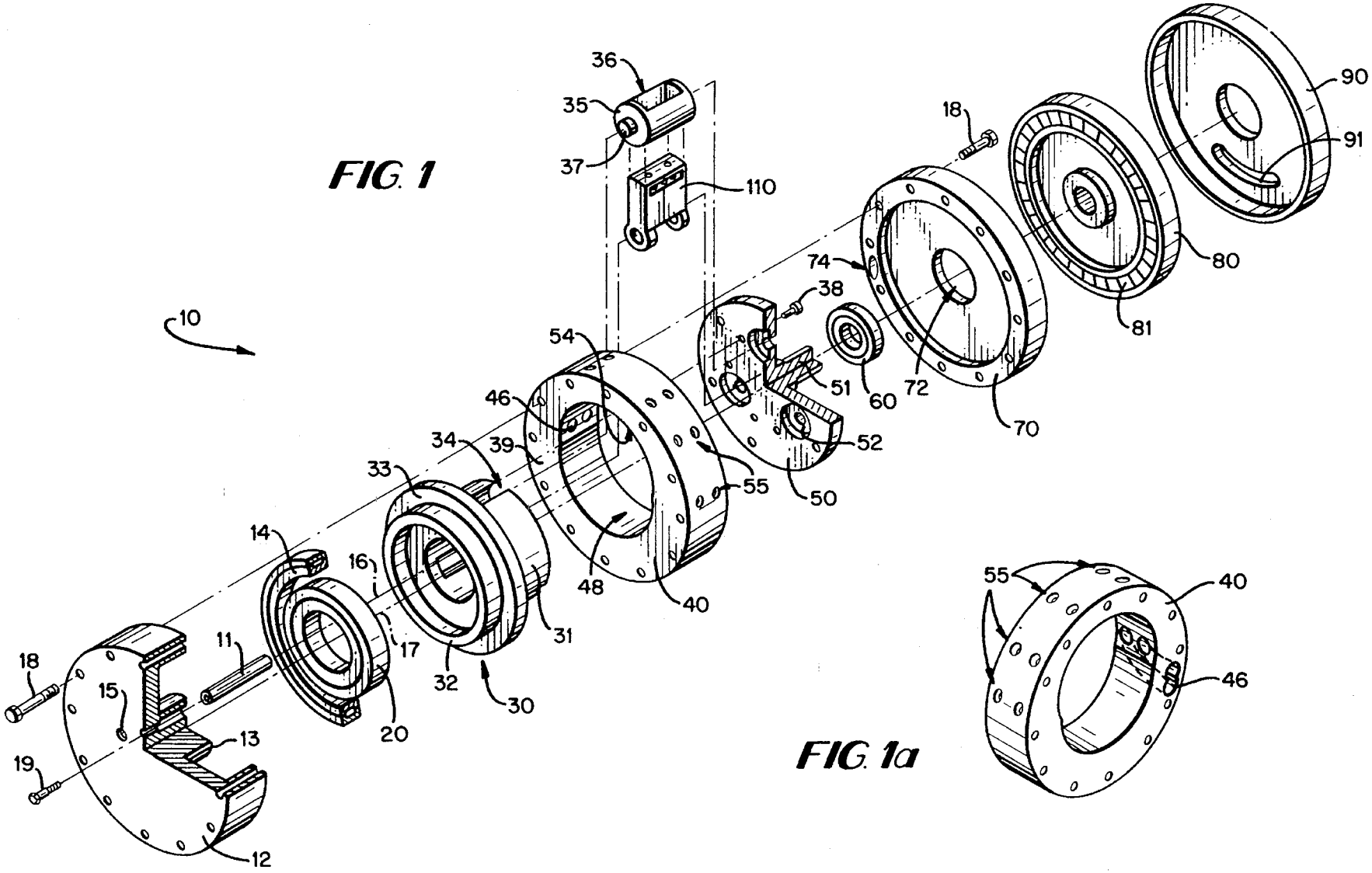
FIG. 1 is an exploded rear perspective view of the rotary engine of the present invention.
FIG. 1*a* is a front perspective view of the engine block of the present invention, showing the front exhaust port.
Figure 11:
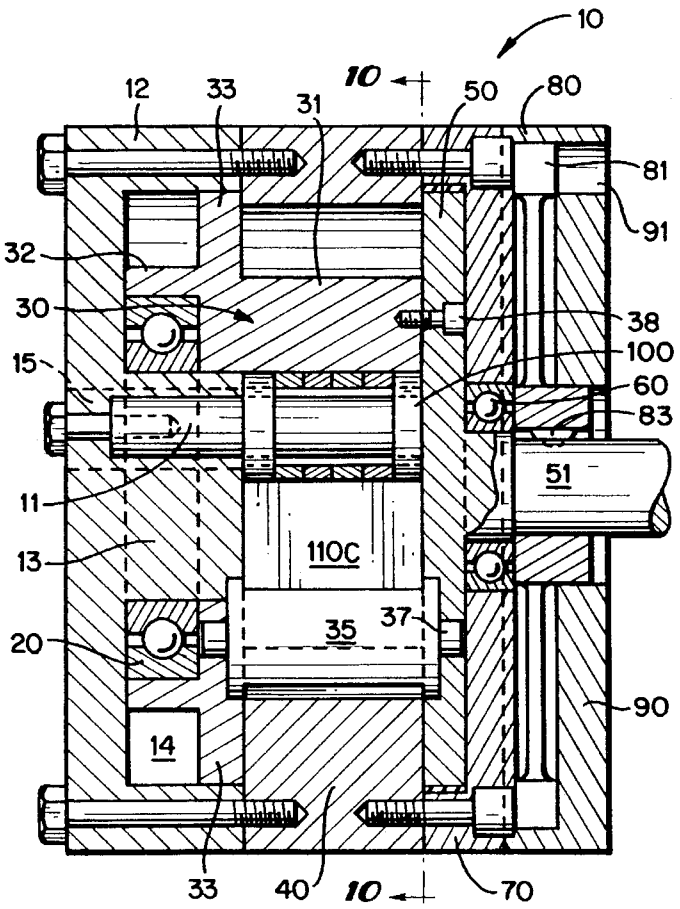
FIG. 11 is a cross-sectional view of the three power pack embodiment of FIG. 10 taken along line 11—11 of FIG. 10.
Figure 10:
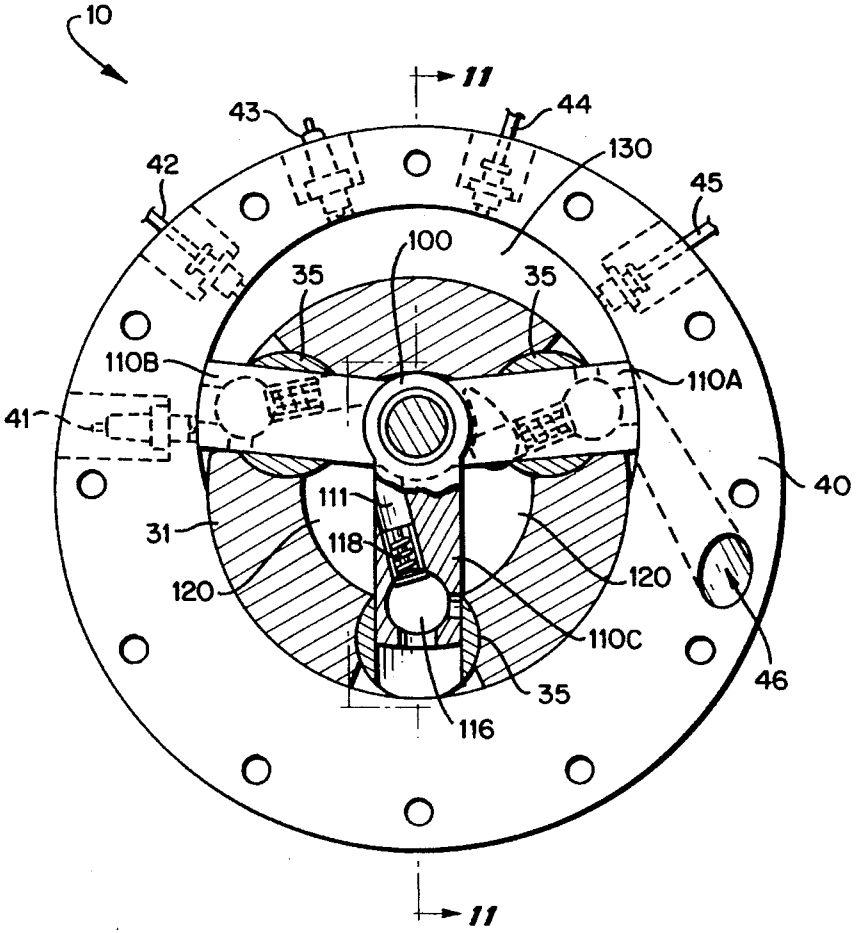
FIG. 10 is a front elevation view of the three power pack embodiment of the present invention in partial cross-section taken along line 10—10 of FIG. 11.
Figure 14:
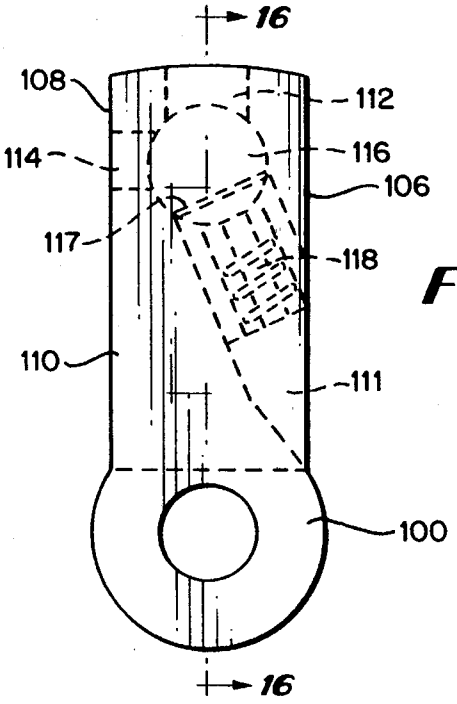
FIG. 14 is a left side view of the power pack of FIG. 12.
Figure 12:
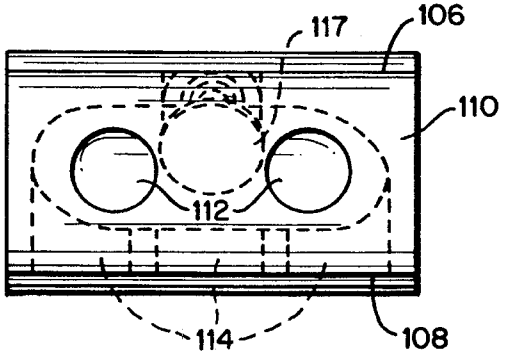
FIG. 12 is a top plan view of a power pack as used in the present invention.
Figure 13:
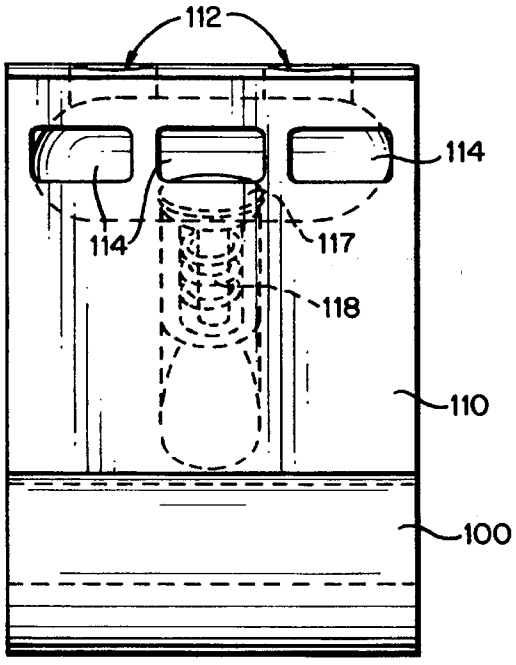
FIG. 13 is a rear view of the power pack of FIG. 12.

Referring to FIGS. 1, 10 and 11 of the drawings, the rotary engine housing assembly 10 of the present invention comprises mating cylindrical engine block covers 12, 70 which house a flywheel assembly 30, an engine block 40, and a flywheel drive shaft plate 50. The housing assembly 10 may be secured together by bolts 18, boss welds or the like. Engine block 40 has a cylindrical outer surface and a hollow interior 48 in the shape of two overlapping cylinders. Rear engine block cover 12 is provided with a carburetor opening 15 through which air or an air/fuel mixture may be input into the engine. The front engine block cover 70 is provided with an exhaust port 74. A stationary power pack shaft 11 anchored by a bolt 19 or the like in an inner hub portion 13 of the rear engine block cover 12 extends through the flywheel 30 and engine block 40 along the longitudinal axis 16 of the upper cylindrical cavity.

The flywheel 30 includes an extended hub 33 having a circular ring portion 32 on one face and a power pack spacer portion 31 on the opposite face. As the hub 33 mates with the flat side surface 39 of the engine block 40, the power pack spacer portion 31 occupies the lower cylindrical cavity of the engine block interior 48. The flywheel ring portion 32 is adapted to receive a ball bearing member 20 which mates with the inner hub portion 13 of the rear engine block cover 12 so as to provide support for rotation of the power pack spacer portion 31 within the engine block 40 about the longitudinal axis 17 of the lower cylindrical cavity. The engine block 40 and engine block covers 12, 70 do not rotate during operation of the rotary engine The engine block 40 and the flywheel assembly 30 further cooperate to define a cylindrical intake/compression chamber 120 and a crescent shaped expansion chamber 130. The compression chamber 120 is defined by an internal bore extending through the flywheel 30 sealed on one end by the inner hub portion 13 of rear engine block cover 12 and on the other end by the drive shaft plate 50. The expansion chamber 130 is defined by the area between the outer surface of the flywheel power pack spacer portion 31 and the interior surface 54 of the engine block upper cylindrical cavity. The drive shaft plate 50 and the flywheel extended hub 33 provide the front and back boundaries, respectively, for the expansion chamber 130.

A cylindrical cavity between the rotating flywheel 30 and the rear engine block cover 12 may house additional equipment 14 to enhance engine performance. Such equipment 14 may include, for example, a starter/generator, a battery generator triggered by low voltage, control direct battery operated propulsion, an air, water, or hydraulic pump, or a supercharger to the intake opening 15 to be used if necessary to raise the compression ratio to the level of a diesel engine.

The power pack spacer portion 31 of the flywheel 30 is cylindrical in shape and is provided with cylindrical openings 34 spaced about its circumference for receiving wrist pins 35. The number of openings 34 and corresponding wrist pins 35 is determined by the number of rotary pistons or power packs desired for the operation of the engine. In one embodiment of the invention, as shown in FIG. 10, the number of wrist pins 35 is three. The wrist pins 35 are of sufficient length to extend towards the front engine block cover 70 into wrist pin holes 52 in the drive shaft plate 50, as shown in FIG. 11. Wrist pin extensions 37 extending into the flywheel 30 and the drive shaft plate 50 allow for rotary movement of the wrist pins 35. The drive shaft plate 50 is secured directly to the flywheel 30 by bolts 38 or the like. The shaft 51 of the drive shaft plate 50 is capable of receiving a ball bearing member 60 which mates with a bore 72 in front engine block cover 70 so as to provide support for rotation of the shaft 51.

Each wrist pin 35 is provided with a slot 36 for receiving a power pack 110. Each power pack 110 is rotatably mounted to the power shaft 11 which extends through the flywheel 30 and engine block 40 along the axis 16 of the upper cylindrical cavity of the engine block interior 48. The power packs 110 are of sufficient length to extend from the power shaft 11 to the interior wall of the upper cylindrical cavity of the engine block interior 48, thereby passing through the expansion chamber 130 during rotation. Additionally, each power pack 110 is provided with a channel 111 which allows flow of compressed gases through the power pack 110 to an internal combustion chamber 116. The combustion chamber 116 is an enlarged space at the end of channel 111 which allows the combustion materials to expand in the most efficient manner to maximize the thrust imparted to the power pack 110 upon ignition. The gas compression ratio can be controlled by adjusting the size of the combustion chamber 116 without affecting the length of treatment of the expanding gases. A ball check valve 117 with spring 118 is capable of opening and closing the channel 111 to the flow of combustion elements. The spring 118 urges the valve 117 open when the valve 117 is not under pressure.

Input port 112 is on the top of the power pack 110 and communicates with input holes 55 extending at 45 degree increments through the engine block 40 into the interior 48 of the engine block upper cylindrical cavity. In one embodiment, as shown in FIGS. 1, 1*a* and 12 through 16, input holes 55 and input port 112 have a double hole configuration. Output port 114 is on the aft side of the power pack 110. In one embodiment, as shown in FIGS. 12 through 16, output port 114 includes a series of rectangular openings extending across the width of the power pack 110.

Figure 15:
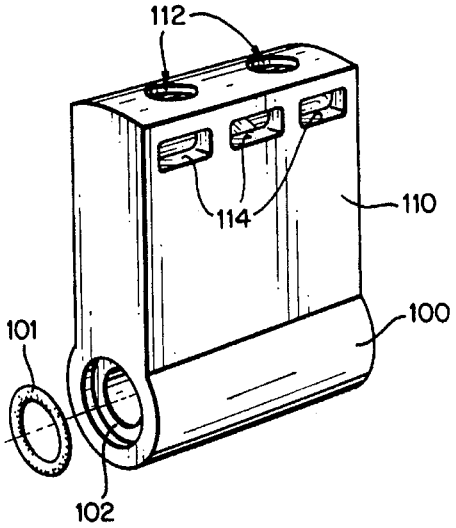
FIG. 15 is a perspective view of the power pack of FIGS. 12 through 14.
Figure 16:
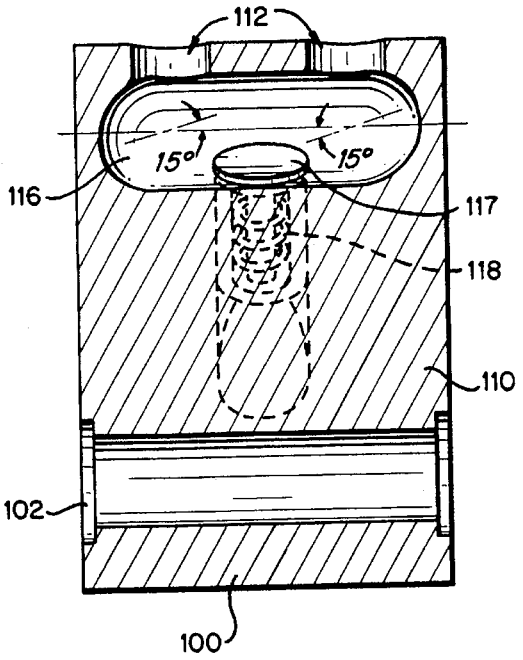
FIG. 16 is a rear cross-sectional view of the power pack of FIGS. 12 through 15 taken along the line 16—16 of FIG. 14.
Figure 17:
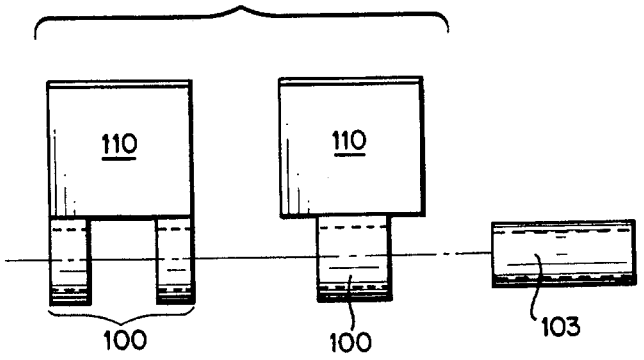
FIG. 17 is a front schematic view of power packs for use in the two power pack embodiment of the present invention.
Figure 18:
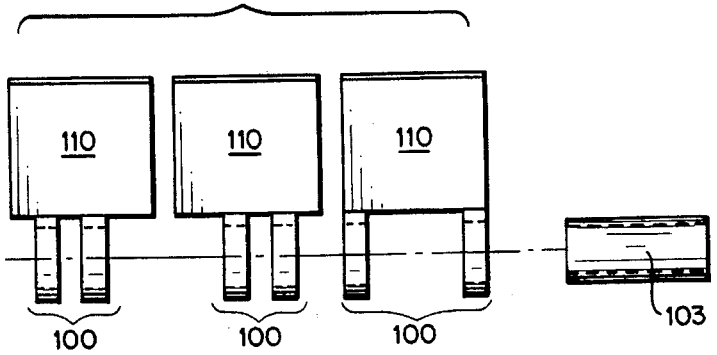
FIG. 18 is a front schematic view of power packs for use in the three power pack embodiment of the present invention.

The hub 100 of the power pack 110 in the single pack configuration is of one piece construction extending across the width of the power pack 110 as shown in FIG. 15. The hub 100 for the two and three pack configurations are shown in FIGS. 17 and 18, respectively. In order to ensure that a gas tight seal is maintained by the hubs 100, an 0-ring 101 is placed within a cavity 102 on both ends of the single power pack 110 as shown in FIGS. 15 and 16. In the two and three pack embodiments of FIGS. 17 and 18, respectively, a continuous floating bushing 103 is positioned within the power pack hubs 100 to maintain a gas tight seal. The surfaces of the bushing 103 actively support the motion of the power packs 110. Additionally, 0-rings may be placed within cavities in the hubs 100 in the multi-blade embodiments to improve the sealing capabilities along the hub mating surfaces.

Thus, by the present invention, the power packs 110 rotate about the axis 16 of the upper cylindrical cavity in the engine block 40 while the wrist pins 35 rotate with the flywheel 30 about the axis 17 of the lower cylindrical cavity in the engine block 40. While the wrist pins 35 never enter the expansion chamber 130, the power packs 110 rotate in full communication with the expansion chamber 130. During this rotation, the wrist pins 35 oscillate within their openings 34 in accordance with the movement of the power packs 110. Since each power pack 110 intermeshes with an individual wrist pin 35 contained within the flywheel 30, rotation of the power packs 110 is translated into rotation of the wrist pins 35 and flywheel 30 about the flywheel axis 17 which thereby rotates the drive shaft plate 50 to drive the drive shaft 51. It is this rotation of the shaft 51 which is the primary purpose of the rotary engine.

The rotation of the power packs 110 is effected by the four strokes associated with the internal combustion engine—intake, compression, power, and exhaust. All four strokes, including the power stroke, are employed during each revolution of the flywheel. This is in contrast to the typical modern-day engine which requires two revolutions of the flywheel to achieve one power stroke.

The operation of the rotary engine is best illustrated by FIGS. 2 through 9 which show the single power pack configuration as the power pack 110 makes one complete revolution. As the power pack 110 rotates clockwise, the pack functions as a traveling combustion chamber having two operational faces-a forward face 106 and an aft face 108. In the rotation through the compression chamber 120, the pack forward face 106 compresses the combustion materials while the aft face 108 acts as a vacuum past the intake opening 15 to sweep in combustion materials for compression by the following power pack or by the next revolution of the single power pack. In the rotation through the expansion chamber 130, the forward face 106 is the exhaust face pushing the materials remaining in the expansion chamber 130 towards exhaust port 46 while the aft face 108 is the power face, accepting the power of the exploded gases in the compression chamber 130.

Figure 2:
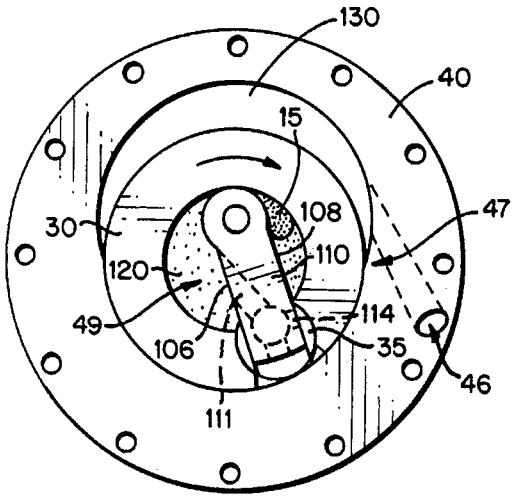
FIGS. 2 through 9 are front schematic views of the single power pack embodiment of the present invention as the power pack rotates one full revolution.
Figure 3:
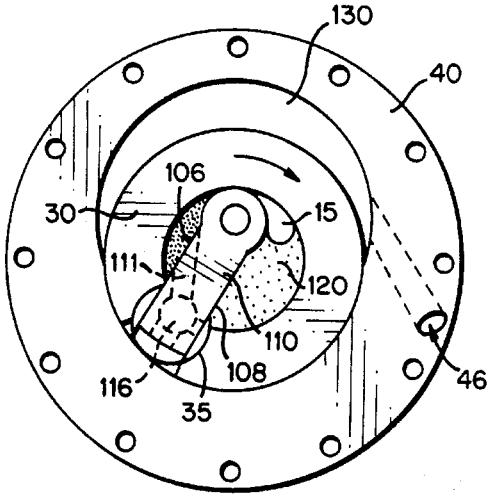

Starting with the power pack at its location in FIG. 2, for example, the passing of power pack 110 past the intake opening 15 creates a suction of the air mixture through the intake opening 15 into the center compression chamber 120. The air mixture remaining from the previous cycle, denoted at 49, begins to be compressed by power pack 110 and begins to enter channel 111 as the ball check valve 117 is in the open position. Since the power pack combustion chamber output port 114 is sealed by wrist pin 35 once the power pack passes the intersection point 47 of the engine block cavity, the available space for the mixture in the compression chamber 120 and the channel 111 quickly becomes smaller, thereby compressing the air mixture contained therein as shown in FIG. 3.

Figure 4:
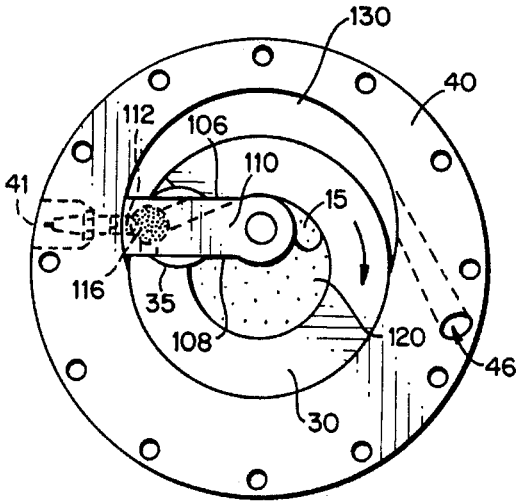

Eventually, this compressed mixture is contained entirely within the power pack combustion chamber 116 such as illustrated in FIG. 4 because there is no room for it left in its corresponding section of the compression chamber 120. The increasing pressure forces the ball check valve 117 closed which closes the combustion chamber 116 to the channel 111 and traps the mixture under extreme pressure. In one embodiment, as shown in FIG. 16, each end of the tubular combustion chamber 116 is enclosed by a parabolic dome, with the focal points being 15 degrees up on one side of the horizontal axis of the combustion chamber 116 and 15 degrees down on the other side. Such a configuration results in a "cross-fire" system wherein the air mixture moves about in a swirling motion.

Figure 5:
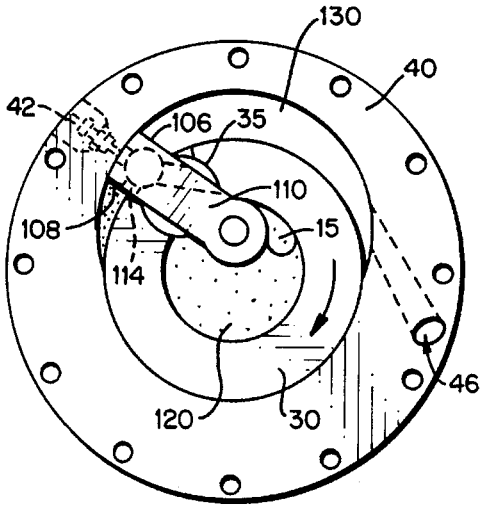

At this point, a pair of spark plugs 41 secured within the first pair of engine block input holes 55 ignites the air/fuel mixture in the combustion chamber 116 as shown in FIG. 4. This ignition occurs without transfer of high pressures to other parts of the engine. Although access to the pack combustion chamber 116 is only available at the exact point where input holes 55 align with the pack input port 112, both ignition and injection can be accomplished in the expansion chamber 130 at any time in the expansion cycle. The firing point may occur at degrees past top dead center, or maximum compression, to allow the combusted gases to reach a higher point of pressure before release. After ignition, the gases are released into the expansion chamber 130 through output port 114, as shown in FIG. 5. The explosion of the compressed mixture propels power pack 110 towards exhaust port 46 as shown in FIGS. 5 through 9. Gases existing in the expansion chamber 130 ahead of the power pack 110 are forced out of the expansion chamber 130 through the engine block exhaust outlet 46. Exhaust outlet 46 may have a double hole configuration, as shown in FIG. 1*a* or may have a single hole configuration as shown in FIGS. 2 through 9.

Figure 6:
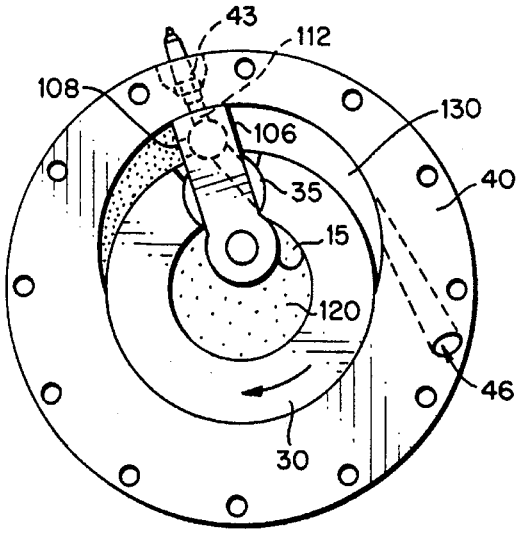
Figure 7:
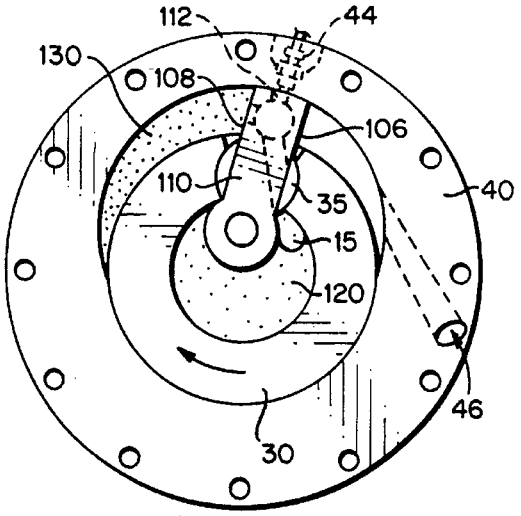
Figure 8:
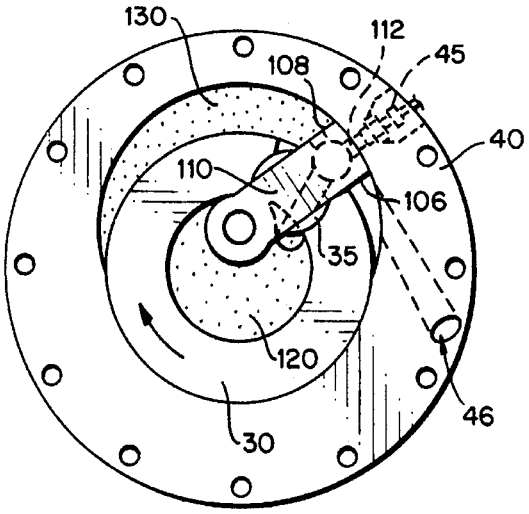

In FIG. 5, an optional fuel injector 42 injects a very lean mixture of air and a hot fuel into the volatile mixture through input port 112 for further powering power pack 110 and burning out the developed pollutants such as CO and hydrocarbons. In FIG. 6, an optional second set of spark plugs 43 further ignites the gaseous mixture. In FIG. 7, an optional water injector 44 injects water into the hot mixture through input port 112, thereby expanding the water into steam and even further powering the power power pack 110. This also changes the low pressure, high temperature gases into higher pressure, higher density usable energy by exhausting through a turbine. In FIG. 8, an optional clean air injector 45 blasts clean air into the expansion chamber 130 through input port 112 to further cleanse the exhaust gases of CO. Throughout the gas expansion cycle, power is directed radially and tangentially into the flywheel 30 giving maximum torque from the combined gases. In one embodiment of the invention, the engine block input holes 55 are of uniform size and the accessories for treating the combustion materials are interchangeable such that any desired sequence of firing and/or injection may be employed.

Figure 9:
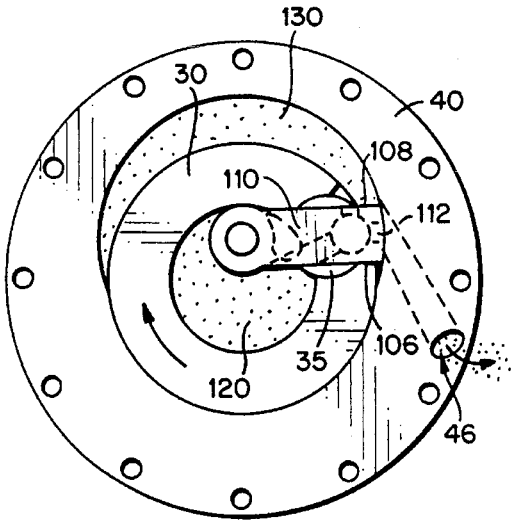

At the end of this power stroke, as shown in FIG. 9, the almost spent gases are exhausted through the engine block exhaust outlet 46 and the exhaust port 74 of the front engine block cover 70 and may thereafter flow into a turbine 80. In one embodiment of the invention, a multi-stage turbine is employed. The turbine 80 may be keyed 83 to the drive shaft 51 as shown in FIG. 11. The turbine power packs 81 recover the remaining heat power normally lost in the typical engine and use it to impart additional torque to the drive shaft 51 before the gases finally exit the entire assembly 10 through the turbine exhaust port 91 in the turbine shroud 90. The turbine shroud 90 may be secured to the front engine block cover 70 by boss welds or the like. In one embodiment of the invention, the expansion cycle of the power packs may be shortened such that a greater percentage of the expanding gases flow into the turbine 90 to be used for turbine power. This would necessitate a multi-stage turbine. In such an embodiment, the higher compression power will have been removed, but greater amounts of the expanding gases will have been passed into the turbine 80 at high pressure.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A rotary engine, comprising:

a hollow casing having outer faces and an interior surface defined by first and second intersecting cylindrical cavities;

a first and second casing cover secured to said casing outer faces;

a flywheel rotatably mounted to said first casing cover so as to rotate within said first cylindrical cavity of said casing, said flywheel having an inner cylindrical bore to define the radial boundaries of a compression chamber within said casing, said flywheel also having an outer surface combining with said casing interior surface defined by said second cylindrical cavity to thereby define the radial boundaries of an expansion chamber within said casing;

a power pack shaft secured to said first casing cover and extending the length of said casing through said compression chamber along the longitudinal of said second cylindrical cavity;

at least one power pack rotatably mounted on said power pack shaft for rotation through said compression and expansion chambers, said at least one power pack including an aft face, an input port and an output port in fluid communication with a combustion chamber at the outer end of said at least one power pack, said output port including at least one opening on said power pack aft face;

power pack engaging means to allow said at least one power pack to slidably engage and rotate with said flywheel;

intake means for permitting combustion elements to enter said compression chamber;

drive means for converting rotation of said flywheel into rotary power;

transport means for permitting combustion elements to flow from said compression chamber through the combustion chamber into said expansion chamber; and exhaust means for permitting release of combustion elements from said expansion chamber.

2. The engine of claim 1 wherein said power pack engaging means comprises at least one slotted wrist pin secured rotatably within limits within said flywheel.

3. The engine of claim 1 wherein said intake means includes an opening in said first casing cover.

4. The engine of claim 1 wherein said exhaust means includes openings in said casing and in said second casing cover.

5. The engine of claim 1 wherein said transport means includes a channel extending through said at least one power pack.

6. The engine of claim 5 wherein said combustion chamber of said at least one power pack is in fluid communication with said channel.

7. The engine of claim 1 wherein said combustion chamber has parabolic dome shaped ends.

8. The engine of claim 7 wherein one of said parabolic dome shaped ends has a focal point fifteen degrees above the horizontal axis of said combustion chamber and the other of said parabolic dome shaped ends has a focal point fifteen degrees below the horizontal axis of said combustion chamber.

9. The engine of claim 1 further including means for treating said combustion elements within said combustion chamber.

10. The engine of claim 9 wherein said casing has an outer surface and wherein said means for treating said combustion elements includes injection openings in said casing outer surface which extend into said expansion chamber.

11. The engine of claim 10 wherein said injection openings are spaced 45 degrees along the outer surface of said casing.

12. The engine of claim 10 wherein said transport means includes a channel extending through said at least one power pack and said combustion chamber is in fluid communication with said channel.

13. The engine of claim 12 wherein said at least one power pack includes an input port and an output port in communication with said combustion chamber.

14. The engine of claim 10 wherein said input port includes two cylindrical holes at the top of said at least one power pack capable of mating with said casing injection openings.

15. The engine of claim 1 wherein said at least one output port opening on said power pack aft face is rectangular in shape.

16. The engine of claim 9 wherein said combustion chamber has parabolic dome shaped ends.

17. The engine of claim 16 wherein one of said parabolic dome shaped ends has a focal point fifteen degrees above the horizontal axis of said combustion chamber and the other of said parabolic dome shaped ends has a focal point fifteen degrees below the horizontal axis of said combustion chamber.

18. The engine of claim 5 further including a valve mounted in said at least one power pack for opening and closing said channel at preselected times during a combustion cycle.

19. The engine of claim 1 wherein said drive means includes a drive shaft plate mounted to said flywheel between said casing and said second casing cover, said drive shaft plate having a drive shaft extending through an opening in said second casing cover.

20. The engine of claim 10 wherein at least one igniter is mounted within an input hole of said casing for communication with said combustion chamber.

21. The engine of claim 10 wherein at least one fuel injector is mounted within an injection opening of said casing for communication with said combustion chamber.

22. The engine of claim 21 wherein said at least one fuel injector includes means for injecting a very lean mixture of air and a hot fuel.

23. The engine of claim 10 wherein at least one water injector is mounted within an injection opening of said casing for communication with said combustion chamber.

24. The engine of claim 10 wherein at least one clean air injector is mounted within an injection opening of said casing for communication with said combustion chamber.

25. The engine of claim 19 further including a turbine mounted to said drive shaft outside of said second casing cover and wherein said exhaust means includes an opening in said second casing cover.

26. The engine of claim 25 including a turbine shroud mounted to said second casing cover, said shroud surrounding said turbine and having an exhaust port and an opening for allowing said drive shaft to extend through said shroud.

27. The engine of claim 1 wherein said flywheel and said first casing cover define a cylindrical chamber therebetween.

28. The engine of claim 1 wherein said combustion chamber is a cross-fire combustion chamber which causes combustion elements flowing through said combustion chamber via said transport means to move about in a swirling motion.

* * * * *

UNITED STATES PATENT AND TRADEMARK OFFICE

CERTIFICATE OF CORRECTION

PATENT NO. : 5,555,866
DATED : September 17, 1996
INVENTOR(S) : Jack A. Wilson

It is certified that error appears in the above-indentified patent and that said Letters Patent is hereby corrected as shown below:

Column 6, line 32, after "longitudinal", insert --axis--

Signed and Sealed this

Seventh Day of January, 1997

*Attest:*

Bruce Lehman

BRUCE LEHMAN

*Attesting Officer*

*Commissioner of Patents and Trademarks*